US009506461B2

(12) United States Patent
Inagaki et al.

(10) Patent No.: US 9,506,461 B2
(45) Date of Patent: Nov. 29, 2016

(54) SEALED COMPRESSOR

(71) Applicant: Panasonic Corporation, Kadoma-shi, Osaka (JP)

(72) Inventors: Ko Inagaki, Shiga (JP); Terumasa Ide, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 305 days.

(21) Appl. No.: 14/350,318

(22) PCT Filed: Oct. 10, 2012

(86) PCT No.: PCT/JP2012/006489

§ 371 (c)(1),
(2) Date: Apr. 7, 2014

(87) PCT Pub. No.: WO2013/054512

PCT Pub. Date: Apr. 18, 2013

(65) Prior Publication Data

US 2014/0234133 A1 Aug. 21, 2014

(30) Foreign Application Priority Data

Oct. 12, 2011 (JP) ..... 2011-224651

(51) Int. Cl.
*F04B 39/00* (2006.01)
*F04B 39/02* (2006.01)

(52) U.S. Cl.
CPC ..... *F04B 39/0061* (2013.01); *F04B 39/023* (2013.01); *F04B 39/0246* (2013.01)

(58) Field of Classification Search
CPC ..... F04B 39/0055; F04B 39/0061
USPC ..... 417/312
See application file for complete search history.

(56) References Cited

U.S. PATENT DOCUMENTS 7,780,421 B2 * 8/2010 Freiberger ..... F04B 39/0061 181/247
2004/0037712 A1 2/2004 Ota et al.
2008/0247886 A1 * 10/2008 Inagaki ..... F04B 39/0061 417/312
2009/0285701 A1 11/2009 Yokota

FOREIGN PATENT DOCUMENTS

| | | |
|---|---|---|
| CN | 1483110 | 3/2004 |
| CN | 1769673 | 5/2006 |
| CN | 101326367 | 12/2008 |
| JP | 55-130081 U | 9/1980 |
| JP | 2003-42064 | 2/2003 |
| JP | 2007-51560 | 3/2007 |
| JP | 2008-267365 | 11/2008 |

OTHER PUBLICATIONS

Office Action issued in corresponding Chinese Application No. 201280049754.5, Aug. 28, 2015, 14 pages—with an English translation.

* cited by examiner

*Primary Examiner* — Patrick Hamo
(74) *Attorney, Agent, or Firm* — Hamre, Schumann, Mueller & Larson, P.C.

(57) ABSTRACT

A sealed compressor of the present invention comprises an electric component (110); a compression component (112); a sealed container (102) which accommodates the electric component (110) and the compression component (112) and stores lubricating oil (104) therein; and a suction pipe (170) which is provided to penetrate a wall portion of the sealed container (102), and through which a refrigerant gas suctioned into the sealed container (102) flows; wherein the compression component (112) includes a compression chamber (142) formed within a cylinder (134) and a suction muffler (146) through which the refrigerant gas flows; wherein the suction muffler (146) includes a muffling space (150), an exit pipe (154), an inlet pipe (152), whose suction port (151) opens in a substantially horizontal direction in the interior of the sealed container (102), a funnel-shaped refrigerant receiver section (160) provided to surround the suction port (151); and wherein the suction port (151) is placed such that its center (151A) is located above than a center (160A) of the refrigerant receiver section (160).

6 Claims, 8 Drawing Sheets

SEALED COMPRESSOR

TECHNICAL FIELD

The present invention relates to a configuration of a sealed compressor. Particularly, the present invention relates to a configuration of a suction muffler placed inside of the sealed compressor.

BACKGROUND ART

In recent years, there have been increasing demands for global environmental conservation. Under the circumstances, refrigerator-freezers for household uses, or air conditioners have been developed to achieve energy saving, and demands for attention to environments in which refrigerator-freezers and the air conditioners are used have been increasing.

To address such attention to the environments, there is known a sealed compressor in which an extending section is provided in the vicinity of an opening of an exit pipe placed inside of a suction muffler by suppressing suctioning of oil to a compression chamber to mitigate a noise (see e.g., Patent Literature 1).

Hereinafter, the conventional sealed compressor will be described with reference to FIGS. 6 to 8. In description below, a relationship of upper and lower sides is on the basis of a state in which the sealed compressor is placed in a normal position.

FIG. 6 is a longitudinal sectional view of the sealed compressor disclosed in Patent Literature 1. FIG. 7 is a cross-sectional view taken along B-B of FIG. 6. FIG. 8 is a cross-sectional view of a suction muffler of the sealed compressor of FIG. 6.

As shown in FIGS. 6 and 7, the sealed compressor disclosed in Patent Literature 1 includes a sealed container 2 and a compressor body 6. In a bottom portion of the sealed container 2, lubricating oil 4 is stored, and the compressor body 6 is elastically supported on the sealed container 2 by a suspension spring 8.

The compressor body 6 includes an electric component 10 and a compression component 12 disposed above the electric component 10. The electric component 10 is a DC brushless motor which includes a stator 14 formed by windings wound around stacked steel plates and a rotor 16 including permanent magnets 15 and is connected to an inverter circuit (not shown) by means of a conductive wire (not shown).

A shaft 18 of the compression component 12 includes a main shaft section 20 and an eccentric shaft section 22 extending above the main shaft section 20. The main shaft section 20 is rotatably mounted to a main bearing 26 of a cylinder block 24. The rotor 16 is fitted to the main shaft section 20. The shaft 18 is provided with an oil feeding mechanism 29 including a spiral groove 28 and the like formed on the outer surface of the main shaft section 20.

The suction muffler 46 is manufactured by molding resin such as PBT, and is retained between a valve plate 40 attached to the end surface of a cylinder 34 and a cylinder head 44 surrounding the valve plate 40. As shown in FIG. 8, the suction muffler 46 includes a muffling space 50, an inlet pipe 52, an exit pipe 54, and a discharge hole 56.

The inlet 52 is placed such that an opening 52*a* which is one end thereof opens in a muffling space 50 and a suction port 51 which is the other end thereof opens in an internal space of the sealed container 2. The exit pipe 54 is placed such that an opening 54*a* which is one end thereof opens in the muffling space 50 and the other end thereof is in communication with a compression chamber 42. The discharge hole 56 is provided in the lower portion of the muffling space 58.

The opening 52*a* of the inlet pipe 52 and the opening 54*a* of the exit pipe 54 are placed so that a flow direction of a refrigerant gas in each opening is horizontal. In the vicinity of the opening 54*a* of the exit pipe 54, an extending section 58 extending radially outward is provided.

Hereinafter, the operation of the sealed compressor disclosed in Patent Literature 1 configured as described above will be described.

Initially, the electric component 10 is actuated by an inverter circuit. According to the rotation of the rotor 16 of the electric component 10, the shaft 18 of the compression component 12 rotates. Then, the compression component 12 performs a predetermined compression operation.

The lubricating oil 4 is suctioned up from the bottom portion of the sealed container 2 up to the upper end of the shaft 18 by the oil feeding mechanism 29 while lubricating the constituents of the compression component 12, and is scattered in the internal space of the sealed container 2. The lubricating oil 4 scattered in the internal space of the sealed container 2 is suctioned from the suction port 51 into the muffling space 50 of the suction muffler 46 via the inlet pipe 52 along with the refrigerant gas. A portion of the lubricating oil 4 suctioned into the muffling space 50 adheres to the outer surface of the exit pipe 54 placed in close proximity to the exit of the inlet pipe 52.

The adhering lubricating oil 4 moves toward the opening 54*a* of the exit pipe 54, by the flow of the refrigerant gas flowing through the inlet pipe 52, but is blocked by the extending section 58. Thereby, the lubricating oil 4 drops downward to the bottom portion of the muffling space 50 and is discharged from the discharge hole 56 to outside of the suction muffler 46. As a result, it becomes possible to suppress unnecessary lubricating oil 4 from being suctioned into the compression chamber 42 through the exit pipe 54.

CITATION LIST

Patent Literature

Patent Literature 1: Japanese-Laid Open Patent Application Publication No. 2007-51560

SUMMARY OF INVENTION

Technical Problem

By the way, in a compressor which lowers a height of the sealed container 2 by using the DC brushless motor and is intended to allow easier use in the refrigerator, the suction port 51 is placed in a low position with respect to an oil level of the lubricating oil 4 in the bottom portion of the sealed container 2.

Because of this, even in the sealed compressor disclosed in the above stated Patent Literature 1, when the refrigerant gas dissolved into the lubricating oil 4 is formed into bubbles and the liquid level rises up to a position in the vicinity of the suction port 51 of the inlet pipe 52, during start-up of the sealed compressor, the bubbles of the lubricating oil 4 may be suctioned from the suction muffler 46 into the compression chamber 42. When the bubbles of the lubricating oil 4 are suctioned into the compression chamber 42, the lubricating oil 4 is compressed in the compression chamber 42, so that a noise is generated.

The present invention is directed to solving the above described problem associated with the prior arts, and an object is to suppress generation of a noise which is caused by suctioning of the bubbles of the lubricating oil generated during the start-up of the sealed compressor.

Solution to Problem

To solve the problem associated with the prior art, a sealed compressor of the present invention comprises a sealed compressor comprising: an electric component; a compression component actuated by the electric component; a sealed container which accommodates the electric component and the compression component and stores lubricating oil therein; and a suction pipe which is provided to penetrate a wall portion of the sealed container, and through which a refrigerant gas suctioned into the sealed container flows; wherein the compression component includes a compression chamber formed within a cylinder and a suction muffler through which the refrigerant gas from an interior of the sealed container toward an interior of the compression chamber flows; wherein the suction muffler includes a muffling space, an exit pipe, one end of which opens in the muffling space and the other end of which opens in the compression chamber, an inlet pipe, one end of which opens in the muffling space, and the other end of which opens in a substantially horizontal direction in the interior of the sealed container, the other end being a suction port of the inlet pipe, and a funnel-shaped refrigerant receiver section provided to surround the suction port; and wherein the suction port is placed such that its center is located above a center of the refrigerant receiver section.

In this configuration, during start-up, etc., even when the lubricating oil stored in the bottom portion of the sealed container is dissolved into the refrigerant gas and is formed into bubbles, and the bubbles of the lubricating oil reach a vertical position of the refrigerant receiver section, the amount of the lubricating oil suctioned into the suction muffler can be reduced, because the suction port is positioned at an upper side as compared to the conventional sealed compressor. As a result, it becomes possible to suppress a large amount of lubricating oil from being suctioned from the suction muffler into the compression chamber.

Advantageous Effects of Invention

The sealed compressor of the present invention is able to suppress the lubricating oil from being suctioned from the suction muffler and lessen the lubricating oil suctioned into the compression chamber, during start-up, etc. As a result, compression of the lubricating oil can be reduced, and generation of a noise or the like caused by the compression of the lubricating oil, can be suppressed.

DESCRIPTION OF EMBODIMENTS

Figure 1:
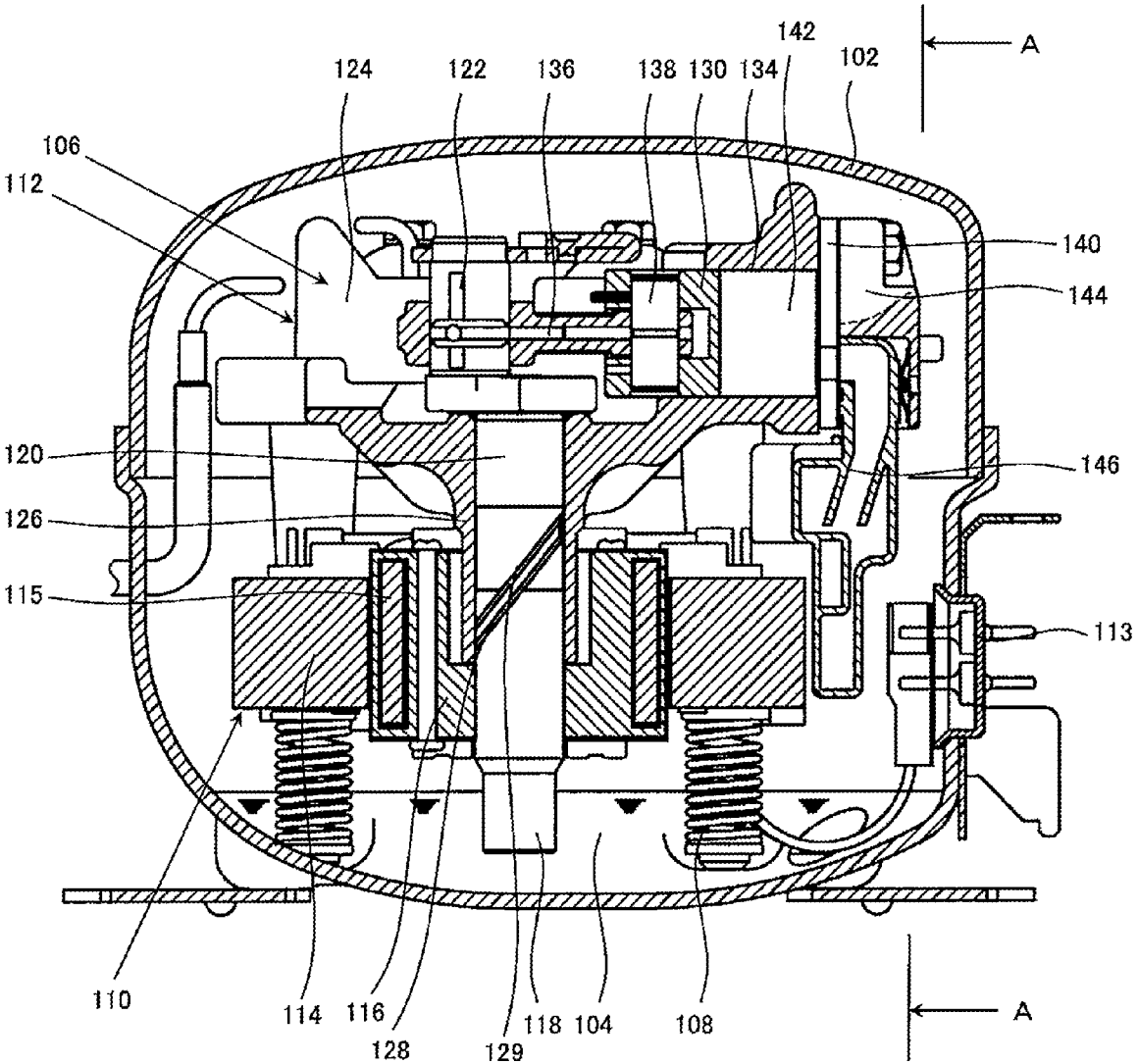
FIG. 1 is a longitudinal sectional view of a sealed compressor according to Embodiment 1.

A sealed compressor of the present invention comprises an electric component; a compression component actuated by the electric component; a sealed container which accommodates the electric component and the compression component and stores lubricating oil therein; and a suction pipe which is provided to penetrate a wall portion of the sealed container, and through which a refrigerant gas suctioned into the sealed container flows; wherein the compression component includes a compression chamber formed within a cylinder and a suction muffler through which the refrigerant gas from an interior of the sealed container toward an interior of the compression chamber flows; wherein the suction muffler includes a muffling space, an exit pipe, one end of which opens in the muffling space and the other end of which opens in the compression chamber, an inlet pipe, one end of which opens in the muffling space, and the other end of which opens in a substantially horizontal direction in the interior of the sealed container, the other end being a suction port of the inlet pipe, and a funnel-shaped refrigerant receiver section provided to surround the suction port; and wherein the suction port is placed such that its center is located above a center of the refrigerant receiver section.

As defined herein, the center of the suction port refers to a vertical center of the suction port in a state in which the sealed compressor is placed for normal use. In the same manner, the center of the refrigerant receiver section refers to a vertical center of the refrigerant receiver section in a state in which the sealed compressor is placed for normal use.

In this configuration, during start-up, etc., even when the refrigerant gas is dissolved into the lubricating oil stored in the bottom portion of the sealed container and is formed into bubbles, and the bubbles of the lubricating oil reach a vertical position of the refrigerant receiver section, the amount of the lubricating oil suctioned into the suction muffler can be reduced, because the suction port is positioned at an upper side as compared to the conventional sealed compressor. In addition, the refrigerant gas can be suctioned from the suction port. As a result, it becomes possible to suppress a large amount of the lubricating oil from being suctioned from the suction muffler into the compression chamber, and suppress generation of a noise or the like which is caused by compression of the lubricating oil.

In the sealed compressor of the present invention, when viewed from a flow direction of the refrigerant gas at an exit of the suction pipe, a center of the suction pipe may conform to a center of the refrigerant receiver section. As defined herein, the center of the suction pipe refers to the center of the downstream opening end (exit) of the suction pipe.

In the sealed compressor of the present invention, the inlet pipe may be placed such that a dimension of a vertical position of a lower end portion of the suction port which is from an inner bottom surface of the sealed container is twice to 3.5 times as large as a depth of an oil level of the lubricating oil during a stopped state of the sealed compressor.

In the sealed compressor of the present invention, the suction port may have a structure in which its vertical width is greater than its horizontal width.

In this configuration, during start-up, etc., even when the bubbles of the lubricating oil flow into the inlet pipe, it becomes possible to avoid a situation in which the bubbles of the lubricating oil are filled over the entire surface of the cross-section of the inlet pipe. Therefore, even when the bubbles of the lubricating oil are formed, the refrigerant gas with a low flow resistance flows through the upper portion of the inlet pipe. Therefore, the lubricating oil suctioned from the suction muffler into the compression chamber can be lessened, and as a result, generation of a noise during start-up can be suppressed more surely.

In the sealed compressor of the present invention, the inlet pipe may have a structure in which its cross-sectional area is greater than a cross-sectional area of the exit pipe.

This allows a sufficient amount of the refrigerant gas to be suctioned into the inlet pipe. Thus, performance of the sealed compressor can be improved. Although the inlet pipe has the cross-sectional area of the flat rectangular shape, a passage resistance in the inlet pipe can be reduced and performance of the sealed compressor can be improved, because the cross-sectional area of the inlet pipe is set greater than the cross-sectional area of the exit pipe.

Hereinafter, embodiment of the present invention will be described with reference to the drawings. The present invention is not limited by the embodiment below.

(Embodiment 1)

[Configuration of Sealed Compressor]

Figure 2:
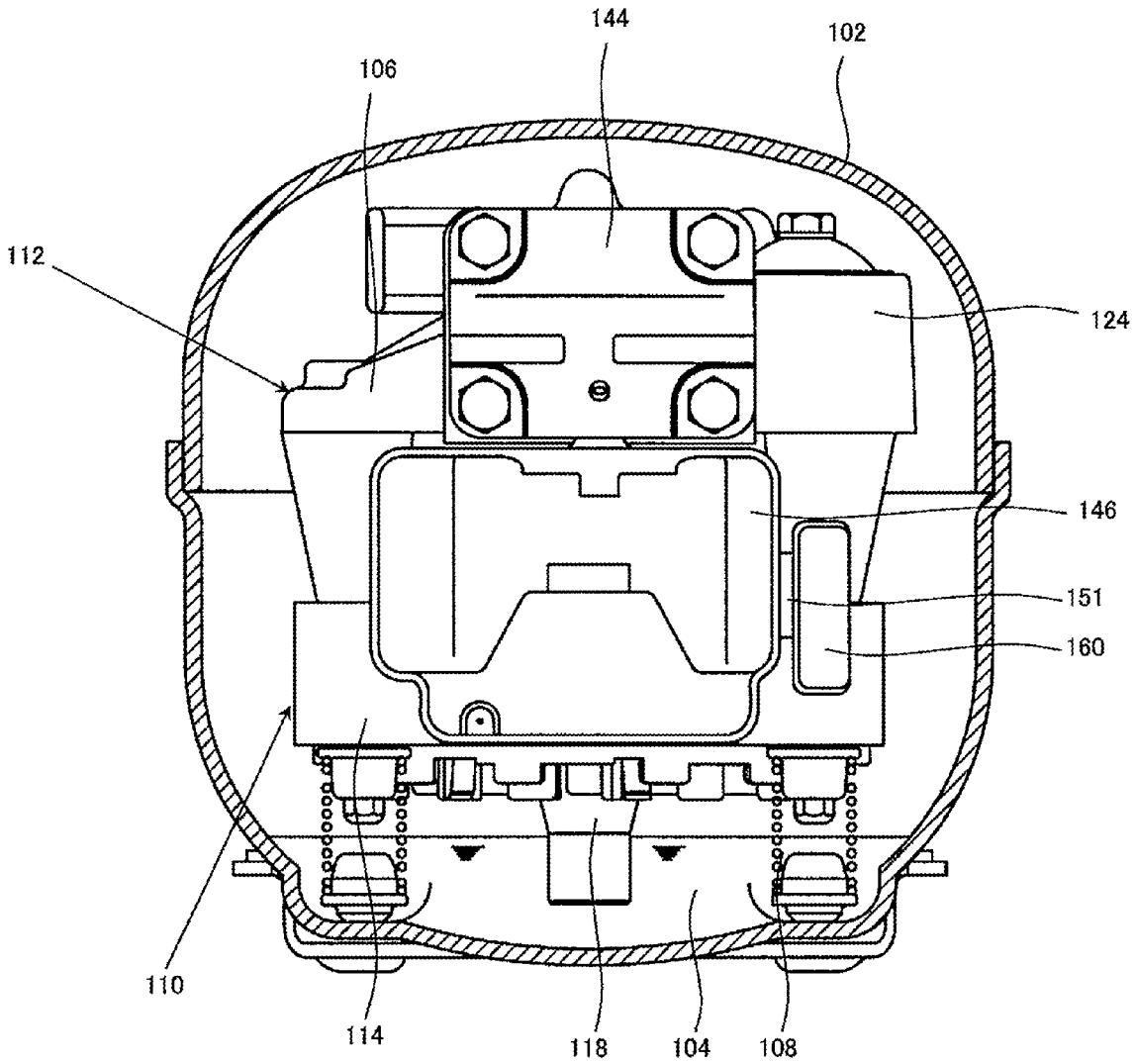
FIG. 2 is a cross-sectional view of the sealed compressor taken along A-A of FIG. 1.
Figure 3:
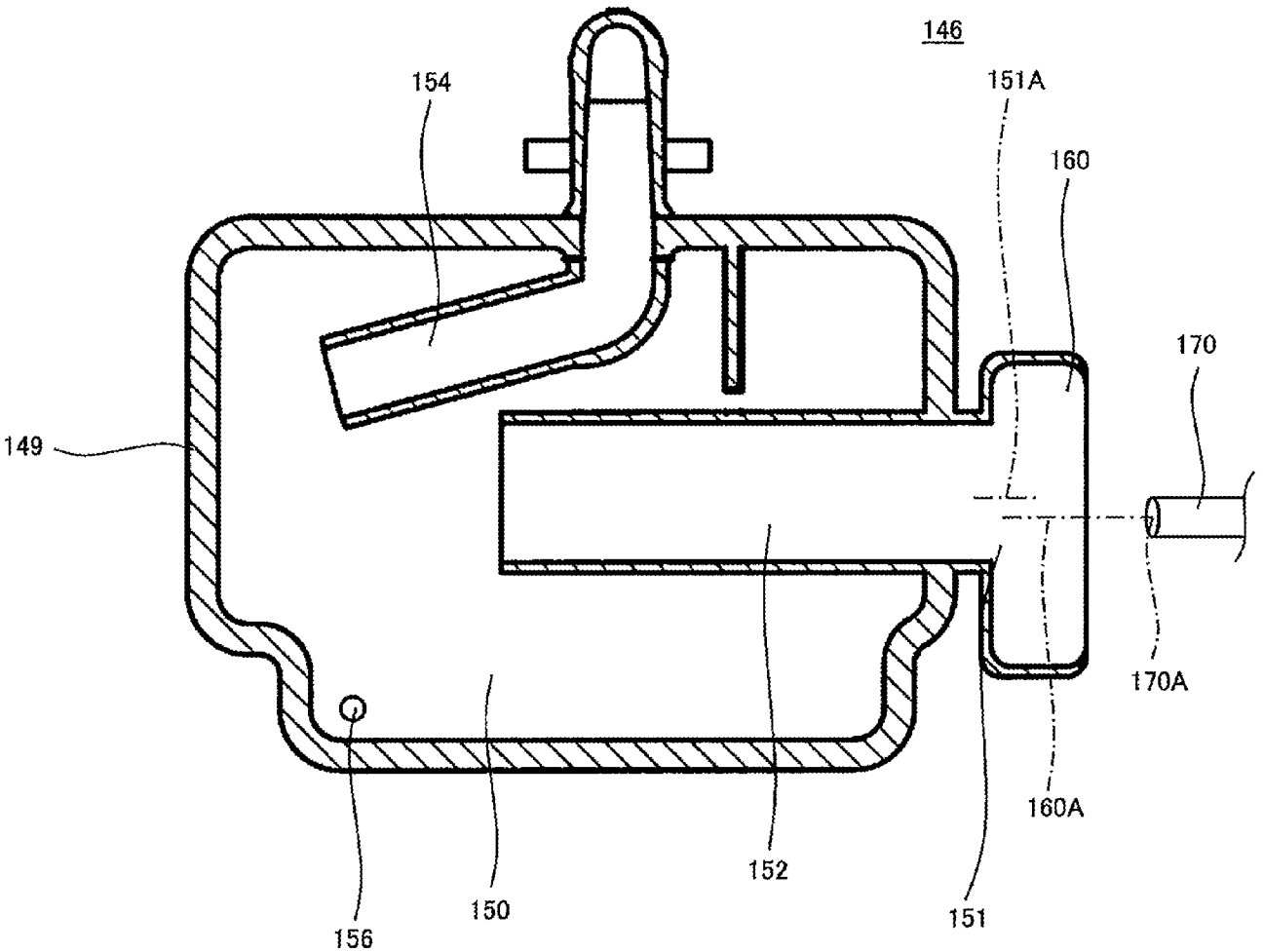
FIG. 3 is a cross-sectional view of a suction muffler of the sealed compressor of FIG. 1.
Figure 4:
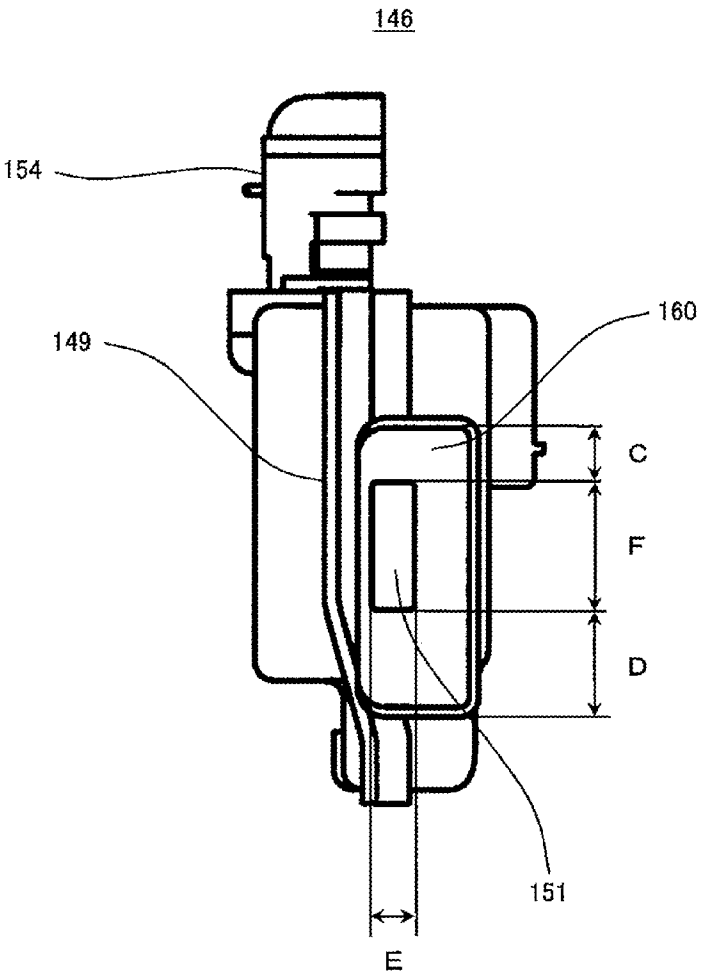
FIG. 4 is a side view of the suction muffler of the sealed compressor of FIG. 1.
Figure 5:
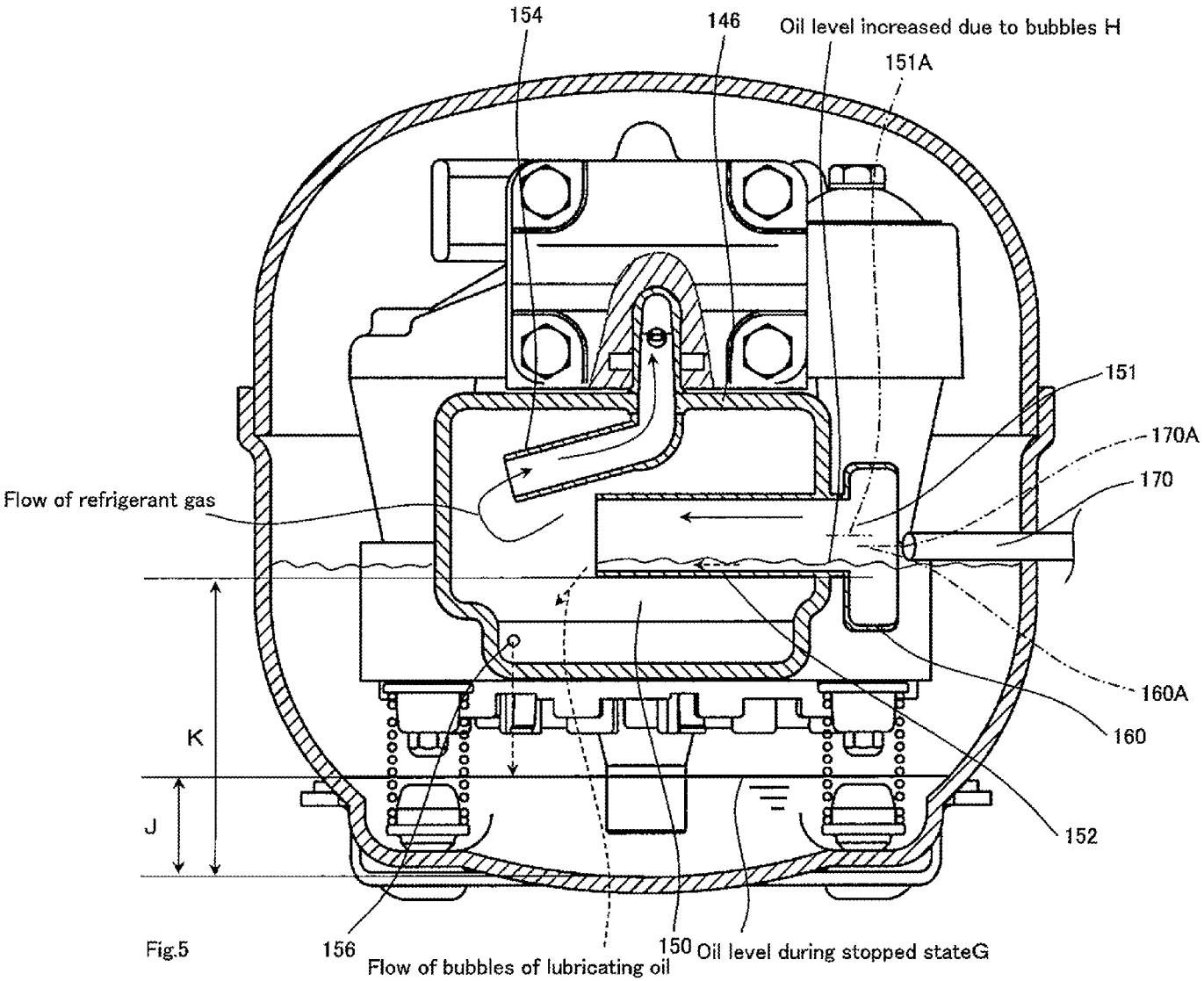
FIG. 5 is a schematic view showing a flow of refrigerant in a case where bubbles of lubricating oil are formed during start-up of the sealed compressor of FIG. 1.
Figure 6:
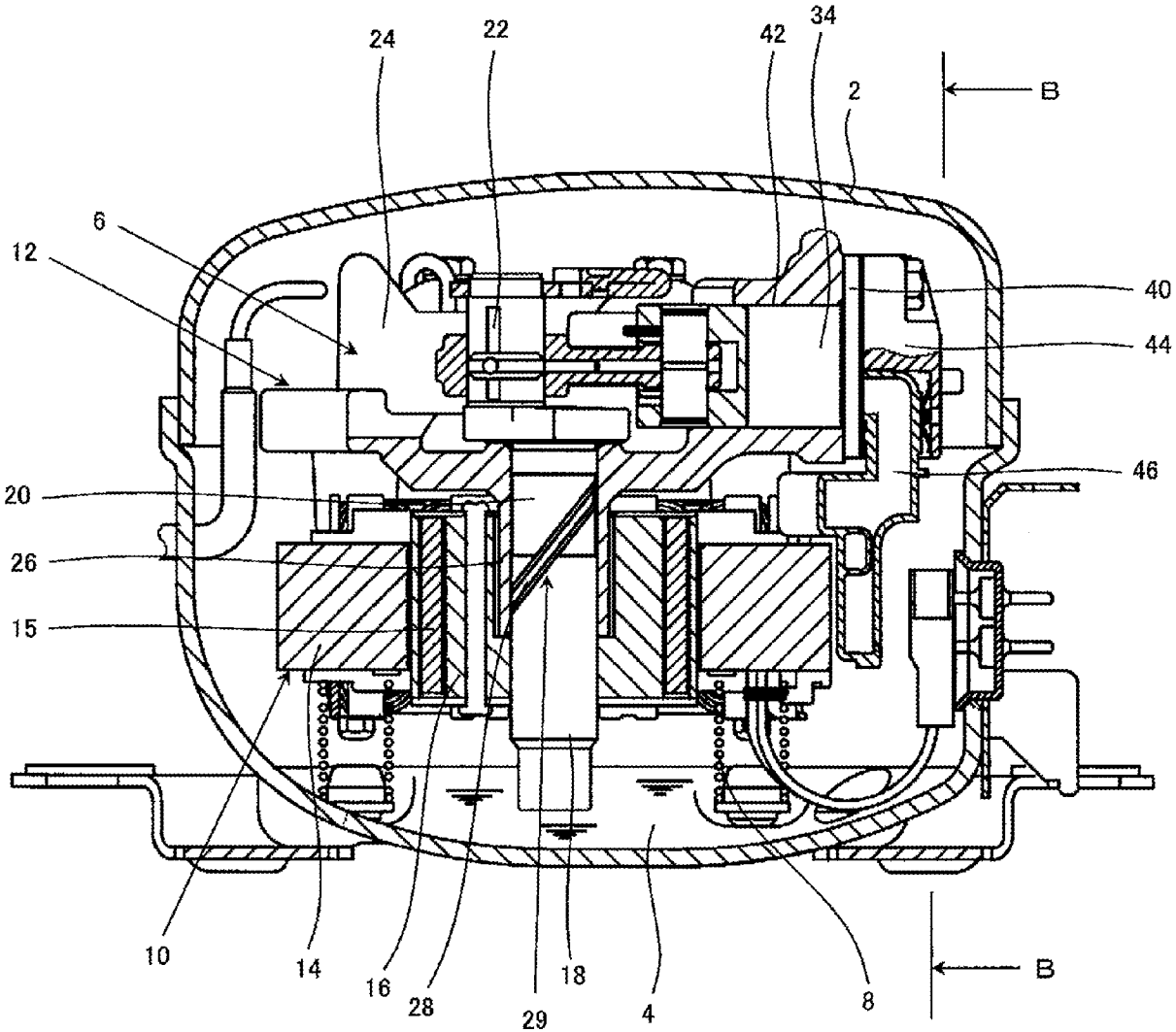
FIG. 6 is a longitudinal sectional view of a sealed compressor disclosed in Patent Literature 1.
Figure 7:
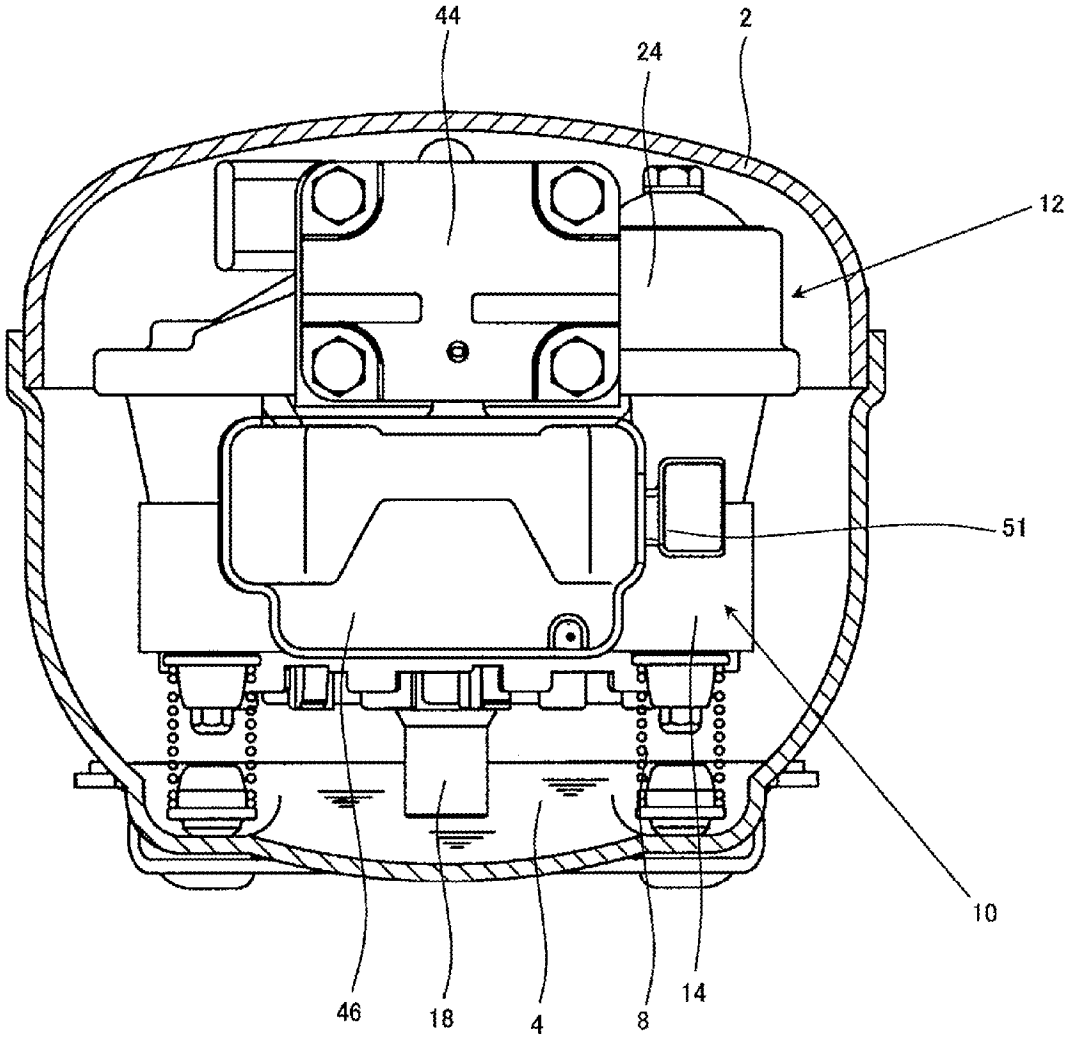
FIG. 7 is a cross-sectional view taken along B-B of FIG. 6.
Figure 8:
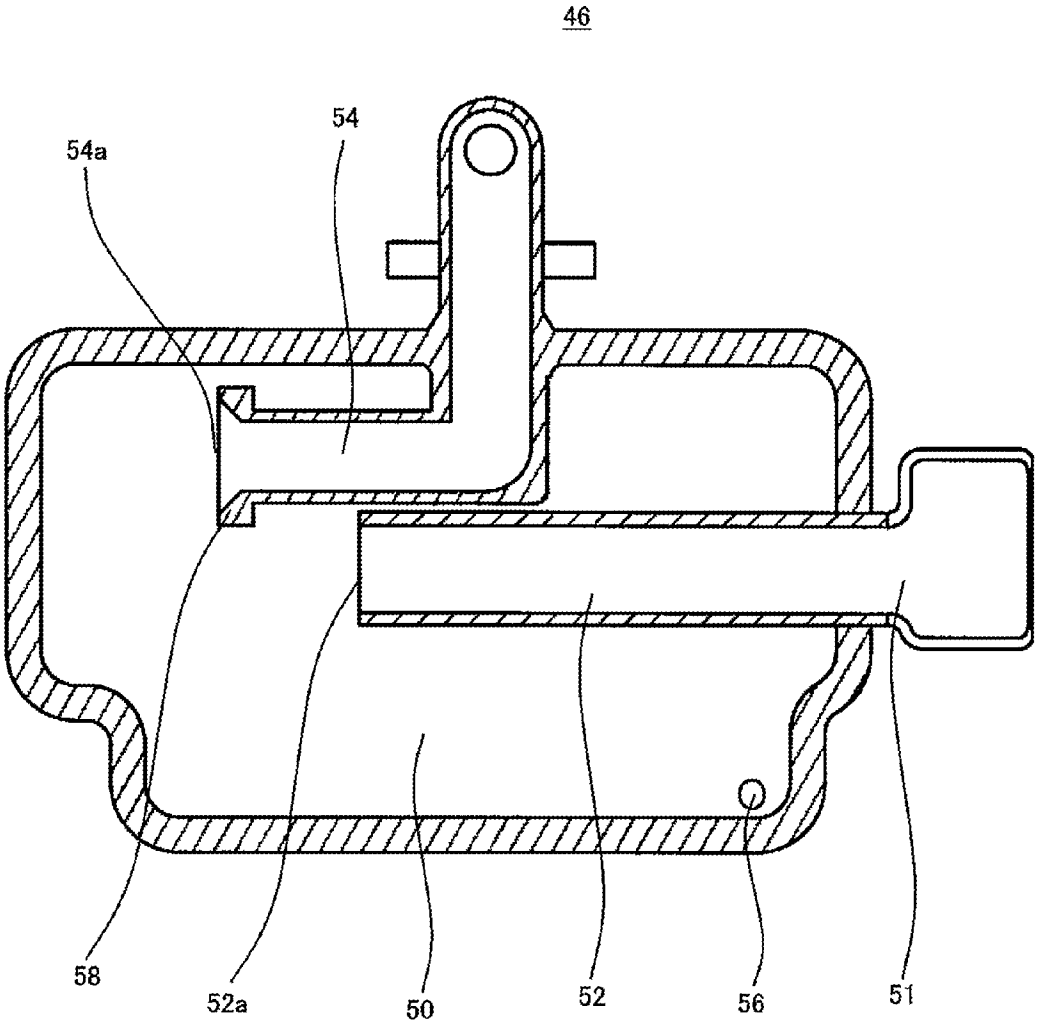
FIG. 8 is a cross-sectional view of a suction muffler in the sealed compressor of FIG. 6.

FIG. 1 is a longitudinal sectional view of a sealed compressor according to Embodiment 1. FIG. 2 is a cross-sectional view of the sealed compressor taken along A-A of FIG. 1. FIG. 3 is a cross-sectional view of a suction muffler of the sealed compressor of FIG. 1. FIG. 4 is a side view of the suction muffler of the sealed compressor of FIG. 1. FIG. 5 is a schematic view showing a flow of refrigerant in a case where bubbles of lubricating oil are formed during the start-up of the sealed compressor of FIG. 1. FIG. 4 shows the side surface of a portion the suction muffler at which a suction port is provided.

As shown in FIGS. 1 to 5, the sealed compressor of Embodiment 1 includes a sealed container 102. The sealed container 102 is filled with R600a (isobutene) as refrigerant which is low in global warming potential. Lubricating oil 104 is stored in the bottom portion of the sealed container 102. A compressor body 106 is elastically supported in the interior of the sealed container 102 by a suspension spring 108.

The compressor body 106 includes an electric component 110 and a compression component 112 actuated by the electric component 110. The sealed container 102 is attached with a power supply terminal 113 through which electric power is supplied to the electric component 110. The sealed container 102 is provided with a suction pipe 170 penetrating a wall portion of the sealed container 102. A refrigerant gas supplied from a refrigeration cycle (not shown) flows through the suction pipe 170. The downstream end (exit) of the suction pipe 170 opens in the interior of the sealed container 102.

Firstly, the electric component 110 will be described.

The electric component 110 is a salient pole concentrated winding DC brushless motor including a tubular stator 114 formed by directly winding windings (not shown) around a plurality of teeth of a stator core comprised of stacked steel plates via insulating members, and a rotor 116 which is placed radially inward relative to the stator 111 and contains permanent magnets 115. The windings of the stator 114 are connected to an inverter circuit (not shown) outside of the sealed compressor by means of a conductive wire via a power supply terminal 113.

Next, the compression component 112 will be described.

The compression component 112 is placed above the electric component 110 and includes a shaft 118, and a cylinder block 124. The shaft 118 includes a main shaft section 120 having an axis oriented vertically, an eccentric shaft section 122 which extends from the upper end of the main shaft section 120 and is parallel to the main shaft section 120, and an oil feeding mechanism 129. The compression component 112 is configured as a cantilever bearing which bears a load applied to the eccentric shaft section 122 by the main shaft section 120 and a main bearing 126 which are placed below the eccentric shaft section 122.

The rotor 116 is fastened to the main shaft section 120 by a suitable method such as shrink-fitting. The oil feeding mechanism 129 includes a spiral groove 28 and the like formed on the outer surface of the main shaft section 120, and is configured to feed the lubricating oil 104 to the main bearing 126 and the like as will be described later.

The cylinder block 124 includes the main bearing 126 having a cylindrical inner surface having a center axis oriented vertically. The main bearing 126 supports the shaft 118 by inserting the main shaft section 120 of the shaft 118 into the main bearing 126 such that the main shaft section 120 is rotatable.

The cylinder block 124 is provided with a cylindrical cylinder 134 having an axis oriented horizontally. A piston 130 is inserted into the cylinder 134 such that the piston 130 is advanceable and retractable. The piston 130 is attached with a piston pin 138. A joining means 136 has holes at both end portions thereof. The joining means 136 joins the eccentric shaft section 122 to the piston 130 in such a manner that the piston pin 138 and the eccentric shaft section 122 are fittingly inserted into the holes provided in the both end portions of the joining means 136, respectively.

A valve plate 140 is attached to the end surface of the cylinder 134. The valve plate 140, the cylinder 134 and the piston 130 define a compression chamber 142. A cylinder head 144 is fastened to the valve plate 140 such that it serves as a lid for covering the valve plate 140. A suction muffler 146 is retained between the valve plate 140 and the cylinder head 144. More specifically, a portion of an exit pipe 154 of the suction muffler 146 as will be described later, which portion is extended to outside of a muffler body 149, is retained between the valve plate 140 and the cylinder head 144.

As shown in FIG. 3, the suction muffler 146 is mainly formed of a synthetic resin such as PBT (polybuthylene terephthalate) which is a crystalline resin added with glass fibers, and includes a muffler body 149, an inlet pipe 152 and an exit pipe 154.

The muffler body 149 has a rectangular parallelepiped shape which is elongated laterally and has a predetermined thickness. The muffler body 149 has a structure in which a dimension in its height direction (vertical direction) is smaller than a lateral width dimension. The muffler body 149 is placed such that its thickness direction conforms to a reciprocation direction of the piston 130. The muffler body 149 is placed below the cylinder head 144 (see FIG. 1). The upper end portion of the muffler body 149 is located in the vicinity of the lower end portion of the cylinder head 144, while the lower end portion of the muffler body 149 is located in the vicinity of the lower end portion of the stator 114 of the electric component 110.

A muffling space 150 is formed inside of the muffler body 149. As shown in FIG. 3, the muffling space 150 has a substantially rectangular shape in which its vertical dimension is smaller than its lateral width. A discharge hole 156 is provided in the lower portion of a side wall defining the muffling space 150 of the muffler body 149.

Since in the sealed compressor of Embodiment 1, the suction muffler 146 which is small in height, the electric component 110 which is the DC brushless motor which is smaller in height than an induction motor, etc., are used, the sealed container 102 is allowed to have a small height. Therefore, if the sealed compressor of Embodiment 1 is incorporated into a refrigerator, a large internal volume can be ensured.

The inlet pipe 152 has a tubular shape, and penetrates the side wall of the muffler body 149. The inlet pipe 152 is placed such that one end thereof opens in the muffling space 150 and the suction port 151 which is the other end opens in the interior of the sealed container 102 in a substantially horizontal direction.

The exit pipe 154 has a substantially L-shape and penetrates the upper wall of the muffler body 149. The exit pipe 154 is placed such that one end thereof opens in the muffling space 150 and the other end thereof is in communication with the compression chamber 142. The shape and volume of the muffling space 150, and the lengths, cross-sectional areas and opening positions of the inlet pipe 152 and the exit pipe 154 are designed so as to attain a proper muffling effect. This will be described in detail later.

A bowl-shaped refrigerant receiver section 160 is provided around the suction port 151 such that the refrigerant receiver section 160 extends like a funnel from the suction port 151. As shown in FIGS. 3 and 5, the refrigerant receiver section 160 is placed to face an opening end of the suction pipe 170 supplied with the refrigerant gas from the refrigeration cycle (not shown) with a gap with the opening end. More specifically, the refrigerant receiver section 160 and the suction pipe 170 are placed such that a center 160A of the refrigerant receiver section 160 and a center 170A of the suction pipe 170 conform to each other, when viewed from a flow direction of the refrigerant gas flowing through inside of the suction pipe 170.

As defined herein, the center 160A of the refrigerant receiver section 160 refers to a vertical center of the refrigerant receiver section 160 in a state in which the sealed compressor is placed for normal use. In other words, the center 160A of the refrigerant receiver section 160 refers to an intermediate position between the upper end and lower end of the refrigerant receiver section 160. Also, the center 170A of the suction pipe 170 refers to a center of a downstream opening end of the suction pipe 170.

As shown in FIGS. 3 to 5, the refrigerant receiver section 160 has a vertical dimension which is equal to or more than twice as large as a dimension of a vertical position of the suction port 151. A center 151A of the suction port 151 is located above the center of the refrigerant receiver section 160. In other words, the suction port 151 is placed such that the center 151A is above the center 160A of the refrigerant receiver section 160.

Specifically, as shown in FIG. 4, the suction port 151 and the refrigerant receiver section 160 are placed such that a width D of a portion of the refrigerant receiver section 160 which is below the suction port 151 is greater than a width C of a portion of the refrigerant receiver section 160 which is above the suction port 151, and is preferably equal to or more than twice as large as the width C. The center 151A of the suction port 151 refers to a vertical center of the suction port 151 in a state in which the sealed compressor is placed for normal use.

In this structure, even when the bubbles of the lubricating oil 104 are formed during, for example, start-up of the sealed compressor, it becomes possible to suppress the bubbles of the lubricating oil 104 from flowing from the refrigerant receiver section 160 to the suction port 151 as compared to the conventional sealed compressor.

Even if the bubbles of the lubricating oil 104 reach the vertical position of the refrigerant receiver section 160, the amount of the lubricating oil 104 flowing from the suction port 151 into the muffling space 150 of the suction muffler 146 can be reduced, and therefore the refrigerant gas can flow more easily from the upper portion of the refrigerant receiver section 160 into the suction port 151, because the suction port 151 is located above the refrigerant receiver section 160, as compared to the conventional sealed compressor. This makes it possible to suppress a large amount of the lubricating oil 104 from being suctioned from the suction muffler 146 into the compression chamber 142. As a result, generation of a noise due to compression of the lubricating oil, etc., can be suppressed.

By the way, during the operation of the sealed compressor, etc., the cylinder head 144 or the cylinder block 124 is in a high-temperature condition, due to the compression of the refrigerant gas, and hence an upper space in the interior of the sealed container 102, where the cylinder head 144 and the cylinder block 124 are disposed, is also in a high-temperature condition. In addition, the lubricating oil 104 scatters from the tip end of the shaft 118. In light of this, to suppress heating of the suction muffler 146 and suctioning of the scattered lubricating oil 104, the refrigerant receiver section 160 and the suction port 151 (inlet pipe 152) are preferably placed at a lower side in the interior of the sealed container 102. On the other hand, as described above, to suppress the bubbles of the lubricating oil 104 from flowing into the suction port 151 during start-up of the sealed compressor, or the like, the refrigerant receiver section 160 and the suction port 151 (inlet pipe 152) are preferably placed at an upper side in the interior of the sealed container 102.

In light of the above, in the sealed compressor of Embodiment 1, as shown in FIG. 5, the refrigerant receiver section 160 is positioned so that a dimension K of a vertical position of the refrigerant receiver section 160 which is from the inner bottom surface of the sealed container 102 is twice to 3.5 times as large as a depth J of an oil level of the lubricating oil 104 during a stopped state of the sealed compressor. The dimension K of the vertical position is a dimension between the inner bottom surface of the sealed container 102 and the lower end portion of the suction port 151 of the inlet pipe 152. During the stopped state of the sealed compressor, the oil level of the lubricating oil 104 is lower than the lower end portion of the electric component 110 (to be precise, stator 114), and only the lower end portion of the shaft 118 is immersed in the lubricating oil 104.

In the above structure, a low-temperature refrigerant gas can flow from the refrigerant receiver section 160 into the suction port 151, and it becomes possible to suppress the bubbles of the lubricating oil 104 from flowing into the suction port 151, even if the bubbles of the lubricating oil 104 are generated during start-up of the sealed compressor, etc.

Furthermore, as shown in FIGS. 3 and 4, the inlet pipe 152 has a structure in which the vertical dimension F is greater than the lateral width E and preferably has a flat rectangular cross-section which is equal to or more than twice as large as the cross-section of the exit pipe 154 in which longitudinal and lateral widths are almost equal to each other.

[Operation and Advantages of Sealed Compressor]

Next, the operation and advantages of the sealed compressor of Embodiment 1 configured above will be described.

Initially, when the electric component 110 is supplied with electric power via the power supply terminal 113, the stator 114 generates a magnetic field, causing the rotor 116 to rotate together with the shaft 118.

The oil feeding mechanism 129 which operates according to the rotation of the shaft 118 causes the lubricating oil 104 stored in the bottom portion of the sealed container 102 to move upward from the lower end of the shaft 118 to the upper end of the shaft 118, and lubricates sliding sections of the compression component 112. Also, a portion of the lubricating oil 104 is scattered from the upper end of the eccentric shaft section 122 to the inner space of the sealed container 102.

An eccentric rotation of the eccentric shaft section 122 which is caused by the rotation of the main shaft section 120 is converted into a linear reciprocation motion by the joining means 136, which causes the piston 130 to reciprocate within the cylinder 134. Then, the volume of the compression chamber 142 changes, and thereby the refrigerant is suctioned from the sealed container 102 into the compression chamber 142, and compressed therein.

More specifically, in a suction stroke, the refrigerant gas from the refrigeration cycle (not shown) flows into the sealed container 102 via the suction pipe 170. The refrigerant gas flows into the refrigerant receiver section 160 which is placed in close proximity to the opening end of the suction pipe 170 so as to face the opening end of the suction pipe 170. Then, the refrigerant gas flows from the suction pipe 151 into the muffling space 150 via the inlet pipe 152. Then, the refrigerant gas is suctioned into the compression chamber 142 via the exit pipe 154.

Then, in a compression stroke, the refrigerant gas is compressed in the compression chamber 142, and is sent again to the refrigeration cycle via the discharge pipe 148 or the like in a state in which the refrigerant gas is in high-temperature and high-pressure conditions. The suction stroke and the compression stroke are executed alternately in an intermittent manner according to the reciprocation motion of the piston 130.

Next, a behavior of the sealed compressor assumed during the start-up of the sealed compressor will be described with reference to FIG. 5.

The pressure in the inner space of the sealed container 102 is higher during a stopped state of the sealed compressor than a pressure in the inner space of the sealed container 102 during the operation of the sealed compressor. Also, the temperature in the inner space of the sealed container 102 is lower during the stopped state of the sealed compressor than the temperature in the inner space of the sealed container 102 during the operation of the sealed compressor. Because of this, the refrigerant gas is dissolved into the lubricating oil 104 stored in the bottom portion of the sealed container 102. When the sealed compressor is activated in this state, the pressure in the inner space of the sealed container 102 is lowered, and the lubricating oil 104 is stirred by the shaft 118, so that the refrigerant gas dissolved into the lubricating oil 104 is rapidly evaporated and a great amount of bubbles are generated. This may result in a situation in which the oil level rapidly rises from the oil level G during the stopped state as shown in FIG. 5 to the oil level H resulting from the bubbles, and a portion of the refrigerant receiver section 160 becomes below the oil level.

However, in the sealed compressor of Embodiment 1, since the suction port 151 is placed such that the center 151A is located above the center 160A of the refrigerant receiver section 160, at least a portion of the suction port 151 is located above the oil level H formed by the bubbles of the lubricating oil 104. This allows the refrigerant gas to be suctioned through the upper portion of the suction port 151. As a result, it becomes possible to lessen the amount of the bubbles of the lubricating oil 104 which flow into the suction muffler 146.

In addition, as shown in FIG. 4, since the inlet pipe 152 has a structure in which the vertical dimension F is greater than the lateral width E, it is easy to ensure the space in which the refrigerant gas flows through the upper portion of the inlet pipe 152 as shown in FIG. 5, even when the bubbles of the lubricating oil 104 flow to the bottom portion of the inlet pipe 152.

Moreover, since the bubbles of the lubricating oil 104 are lower in flow velocity than the refrigerant gas and are greater in weight than the refrigerant gas, they fall downward in the interior of the muffling space 150 and are discharged to the sealed container 102 through the discharge hole 156. This makes it possible to reduce the amount of the lubricating oil 104 flowing into the compression chamber 142.

By comparison, the refrigerant gas has a smaller flow resistance than the bubbles of the lubricating oil 104. Therefore, the amount of the refrigerant gas flowing through the inlet pipe 152 is greater than the amount of the lubricating oil 104, and the amount of the lubricating oil 104 flowing into the compression chamber 142 can be reduced more effectively. The refrigerant gas flowing into the muffling space 150 is sent from the exit pipe 154 placed above the inlet pipe 152 to the compression chamber 142.

The generation of the bubbles occurs for a short time just after the sealed compressor starts-up. Therefore, the muffling space 150 is not fully filled with the suctioned lubricating oil 104, but the lubricating oil is gradually discharged from the interior of muffling space 150 through the discharge hole 156.

Therefore, it becomes possible to prevent a situation in which a large amount of the lubricating oil 104 is suctioned into the compression chamber 142 and compressed together with the refrigerant gas, and thereby, for example, a noise is generated.

Especially in the sealed compressor in which its height is made smaller by using the DC brushless motor, the position of the suction port 151 of the suction muffler 146 is set lower relative to the oil level. Therefore, it is more likely that the bubbles of the lubricating oil 104 which are generated during the start-up rise to a location in the vicinity of the suction port 151. However, by using the configuration of the present embodiment, generation of the noise can be suppressed effectively.

In addition, in the sealed compressor of Embodiment 1, the refrigerant receiver section 160 has the funnel shape, and its vertical dimension is about twice as high as the dimension of the vertical position of the suction port 151. For this reason, the inner space of the refrigerant receiver section 160 has a great volume, and the refrigerant gas with a relatively low temperature, which inflows from the refrigeration cycle (not shown), tends to stay in the vicinity of the refrigerant receiver section 160. Therefore, the refrigerant gas with a relatively low temperature can be introduced into the suction muffler 146, although the refrigerant gas is suctioned intermittently. In addition, since the suction muffler 146 is formed of the synthetic resin which is lower in heat conductivity than metal, or the like, the refrigerant gas with a low temperature, can be sent to the compression chamber 142. As a result, the efficiency of the sealed compressor can be improved.

Moreover, in the sealed compressor of Embodiment 1, the cross-sectional area of the inlet pipe 152 is set greater than the cross-sectional area of the exit pipe 154. This allows a sufficient amount of the refrigerant gas to be suctioned into the inlet pipe 152. Thus, performance of the sealed compressor can be improved. Although the inlet pipe 152 has the cross-sectional area of the flat rectangular shape, an increase in a passage resistance in the inlet pipe 152 can be suppressed and performance of the sealed compressor can be improved, because the cross-sectional area of the inlet pipe 152 is set greater than the cross-sectional area of the exit pipe 154.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

INDUSTRIAL APPLICABILITY

As should be appreciated from the above, a sealed compressor of the present invention is able to suppress generation of a noise during start-up, which is caused by compressing lubricating oil, and therefore is widely applicable to air conditioners, vending machines, or other refrigeration units, as well as refrigerator-freezers for household uses.

REFERENCE SIGNS LIST

102 sealed container
104 lubricating oil
110 electric component
112 compression component
114 stator
116 rotor
118 shaft
120 main shaft section
122 eccentric shaft section
124 cylinder block
126 main bearing
130 piston
134 cylinder
136 joining means
142 compression chamber
146 suction muffler
150 muffling space
151 suction port
152 inlet pipe
154 exit pipe
160 refrigerant receiver section
170 suction pipe

The invention claimed is:

1. A sealed compressor comprising:

an electric component;

a compression component actuated by the electric component;

a sealed container which accommodates the electric component and the compression component and stores lubricating oil therein; and a suction pipe which is provided to penetrate a wall portion of the sealed container, and through which a refrigerant gas suctioned into the sealed container flows;

wherein the compression component includes a compression chamber formed within a cylinder and a suction muffler through which the refrigerant gas flows from an interior of the sealed container toward an interior of the compression chamber;

wherein the suction muffler includes a muffling space, an exit pipe, one end of which opens in the muffling space and the other end of which opens in the compression chamber, an inlet pipe, one end of which opens in the muffling space, and the other end of which opens in a substantially horizontal direction in the interior of the sealed container, the other end being a suction port of the inlet pipe, and a funnel-shaped refrigerant receiver section provided to surround the suction port; and wherein the suction port is placed such that its center is located above a center of the refrigerant receiver section.

2. The sealed compressor according to claim 1, wherein when viewed from a flow direction of the refrigerant gas at an exit of the suction pipe, a center of the suction pipe conforms to the center of the refrigerant receiver section.

3. The sealed compressor according to claim 1, wherein the inlet pipe is placed such that a dimension of a vertical position of a lower end portion of the suction port which is from an inner bottom surface of the sealed container is twice to 3.5 times as large as a depth of an oil level of the lubricating oil during a stopped state of the sealed compressor.

4. The sealed compressor according to claim 1, wherein the suction port has a structure in which its vertical width is greater than its horizontal width.

5. The sealed compressor according to claim 1, wherein the inlet pipe has a structure in which its cross-sectional area is greater than a cross-sectional area of the exit pipe.

6. The sealed compressor according to claim 1, wherein the center of the suction port is a vertical center of the suction port, and wherein the center of the refrigerant receiver section is a vertical center of the refrigerant receiver section.

* * * * *